United States Patent [19]

Mullins, Jr.

[11] Patent Number: 4,474,023

[45] Date of Patent: Oct. 2, 1984

[54] ICE MAKING

[76] Inventor: James N. Mullins, Jr., 2116 Williams Pl., Fort Worth, Tex. 76111

[21] Appl. No.: 463,130

[22] Filed: Feb. 2, 1983

[51] Int. Cl.[3] ..... F25C 1/12

[52] U.S. Cl. ..... 62/137; 62/347; 62/348; 62/352

[58] Field of Search ..... 62/347, 348, 352, 73, 62/74, 345, 66, 340, 356, 137

[56] References Cited

U.S. PATENT DOCUMENTS

| | | | |
|---|---|---|---|
| 1,925,616 | 9/1933 | Velut | 62/356 X |
| 2,586,588 | 2/1952 | Weseman et al. | 62/348 |
| 3,003,327 | 10/1961 | Cox et al. | 62/352 X |
| 3,130,556 | 4/1964 | Goldsborough | 62/352 X |
| 3,430,452 | 3/1969 | Dedricks et al. | 62/347 X |
| 3,913,349 | 10/1975 | Johnson | 62/348 X |
| 3,959,981 | 6/1976 | Anderson | 62/356 X |
| 4,154,063 | 5/1979 | Aleksandrow | 62/352 X |
| 4,252,002 | 2/1981 | Mullins, Jr. | 62/344 |
| 4,255,941 | 3/1981 | Bouloy | 62/347 |
| 4,366,679 | 1/1983 | Van Steenburgh, Jr. | 62/347 |

*Primary Examiner*—William E. Tapolcai

*Attorney, Agent, or Firm*—Wofford, Fails & Zobal

[57] ABSTRACT

Method and apparatus for producing frozen product characterized by flowing liquid substantially uniformly over a substantially vertically oriented freezing mold; supplying liquid refrigerant to a conductive surface in the freezing mold for freezing the liquid into predetermined shapes; collecting the excess liquid into a reservoir and circulating the excess liquid back over the top of the freezing mold, the liquid being at its freezing point; stopping the circulation of the liquid over the freezing mold and initiating a dump mode in which the freezing mold is heated and tilted to dump the frozen product into a receiving bin; detecting when the receiving bin has sufficient frozen product therein and stopping the production of more frozen product until some has been used; repeating the cycle orienting the freezing mold substantially vertically and starting the refrigeration equipment to freeze the product and repeat the cycle. The preferred embodiment include controls responsive to sensory inputs, deflection plate for deflecting the frozen product into the bin, inclined trough drain to stationary reservoir, insert for freezing easily broken tails between cubes and a special bin.

5 Claims, 15 Drawing Figures

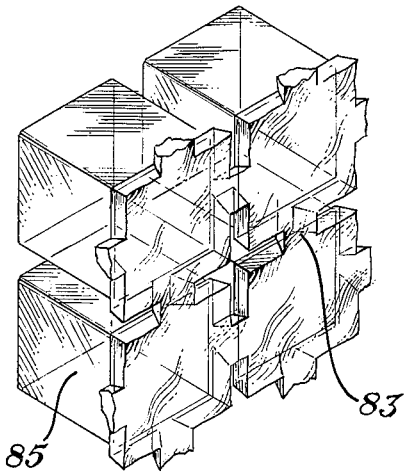
Fig. 5
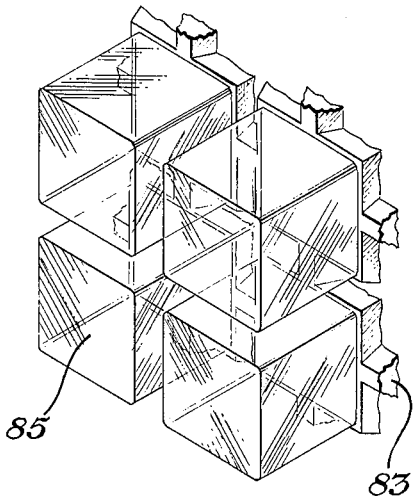
Fig. 6
Fig. 4
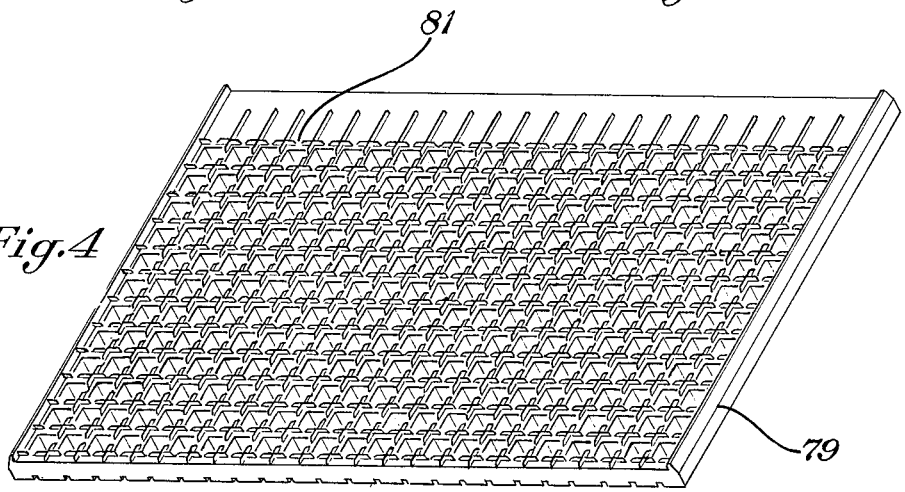
Fig. 7
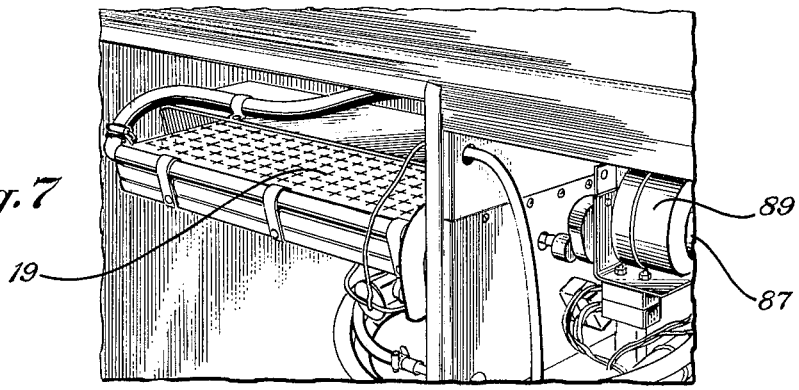

ICE MAKING

FIELD OF THE INVENTION

This invention relates generally to a method of and apparatus for making and storing relatively small chunks of frozen product of a substantially uniform shape. More particularly, this invention relates to the method and apparatus employing improved steps for continuously and automatically making and storing substantial quantities of high quality ice cubes.

BACKGROUND OF THE INVENTION

A wide variety of ice makers have been developed in the prior art. These ranged from the early, large ice making apparatus that made 300 pound blocks in salt water brine at sub-freezing temperature to present day automatic ice makers that make small ice cubes contiguous tubes, plates and the like then through suitable thawing means dump the resultant cubes into a bin, or storage receptacle. While any of a number of products may be prepared in desired shapes such as edible bars and frozen confections, the most frequently employed apparatus of this type is that for producing ice cubes for restaurants, motels and the like.

There are numerous patents in this area which serve to delineate the consistent progress that has been made in improving this type of apparatus. The most pertinent patent of which I am aware is U.S. Pat. No. 3,430,452. As delineated therein, the National Sanitation Foundation is formulating standards of cleanliness relating to automatic frozen food products and the apparatus and methods for making them. In conforming with such standards, one of the primary objects of this invention is to provide apparatus and method for making the ice cubes to conform with the standards for cleanliness and the like.

One of the defects of the prior art is that the apparatus is not readily dumped unless it has an external sheet frozen to the respective cubes. When the external sheet is frozen, controlling its thickness is difficult and requires expensive, complex, difficulty maintainable controls in order to allow the cubes to separate easily. Otherwise, the sheet ice that forms over the top of the cubes is difficulty broken up into individual cubes instead of sheets of cubes.

Another problem has been detection of an adequate quantity of cubes within a bin and interrupting the ice-making process until some of the ice has been used. In the past this has required complex controls such as "electric eye" type of light and light sensing apparatus, feelers, or the like. Another approach has been the use of a thermal switch. These switches and related temperature—responsive capsules and capillaries require very close adjustments and are susceptible to false indications, such as changes in ambient temperature.

SUMMARY OF THE INVENTION

Accordingly, it is an object of this invention to provide method and apparatus that provide all of the advantages of the prior art and also delineate the problem of removing the cubes while providing a means to enable easily breaking the cubes apart by as little as their fall into the bin.

It is also an object of this invention to provide with it an apparatus achieving the first object and also indicating when the bin is full and stopping the ice cube making apparatus automatically.

It is also an object of this apparatus to employ relatively poor heat conductor between separate cubes.

These and other objects of this invention will become apparent from the descriptive matter hereinafter, particularly when taken in conjunction with the appended drawings.

In accordance with one embodiment of this invention there is provided a method of freezing a frozen product from a liquid into a predetermined shape comprising the respective steps of flowing the liquid substantially uniformly over a substantially vertically oriented freezing mold; supplying liquid refrigerant to a heat conductive surface of the freezing mode for freezing the liquid into the predetermined shape; collecting the excess liquid into a reservoir and circulating the excess liquid back to flow over the freezing mold, the liquid being at its freezing point; stopping the circulation of the liquid over the freezing mold and initiating a dump mode in which the freezing mold is heated and tilted to dump the frozen product into a freezing bin at an appropriate time; detecting when the receiving bin has sufficient frozen product therein and stopping the production of more frozen product until some has been used; and repeating the cycle by orienting the freezing mold vertically; starting refrigerating equipment to freeze the product and repeating the other steps.

In accordance with another embodiment of the invention, there is provided apparatus for making a frozen product such as ice in a predetermined shape and consisting essentially of a freezing mold that is pivotally mounted in a substantially vertical position for freezing and inclined for dumping; refrigerator means incorporating a refrigerant tube secured to wall of freezing mold for circulating liquid refrigerant for freezing and hot refrigerant for dumping; liquid dispensing means disposed above the freezing mold for dispensing liquid uniformly and continuously onto the cells of the freezing mold for freezing; drain means for directing excess liquid from the freezing mold to a reservoir; the liquid circuit and pump means connected with the reservoir so as to take suction therefrom and connected with the liquid dispensing means so as to circulate the liquid at substantially its freezing point; make up means for making up liquid to the reservoir; liquid level control means for controlling liquid level in the reservoir; controls for determining when the apparatus is to be in the freezing mode; in the dump mode and not in the freezing mode; apparatus for pivoting the freezing mold into its inclined position for dumping and a blow down means for blowing down high concentrations of impurities from the reservoir.

In improved embodiments, there are also provided controls to prevent re-entry into the freezing mode when the receiving bin has sufficient product in it; deflection plate for deflecting the frozen product into a receiving bin; inclined trough drain to a stationary liquid reservoir; insert for freezing easily broken tails between cubes; and a special bin.

BRIEF DESCRIPTION OF THE DRAWINGS

FIG. 4 is a isometric view of the front mold insert for separating the ice cubes that are frozen.

FIGS. 5 and 6 show front and back views of an ice cube array as frozen in the freezing mold in FIG. 2 and showing interconnecting tails that are readily broken to provide separation into individual ice cubes as they fall into their storage bin.

FIG. 7 is a partial perspective view of the interior of the ice making apparatus in FIG. 1.

DESCRIPTION OF PREFERRED EMBODIMENTS

Figure 1:
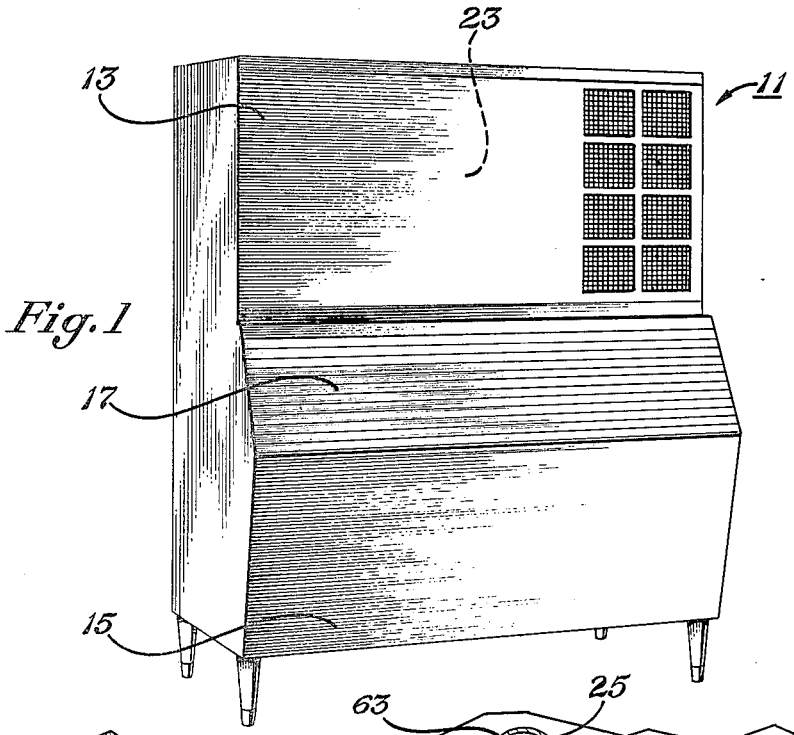
FIG. 1 is a front perspective view of one embodiment of this invention.

Referring to FIG. 1, there is illustrated apparatus 11 for making and storing the frozen product in accordance with one embodiment of this invention. In the apparatus 11, the upper cabinet 13 includes the freezing apparatus and the lower bin 15 provides the storage bin therefor. A door 17 allows access to the interior of the storage bin 15. The external cabinetry, including bin 15 and door 17 are conventional and need not be described in detail herein.

Figure 2:
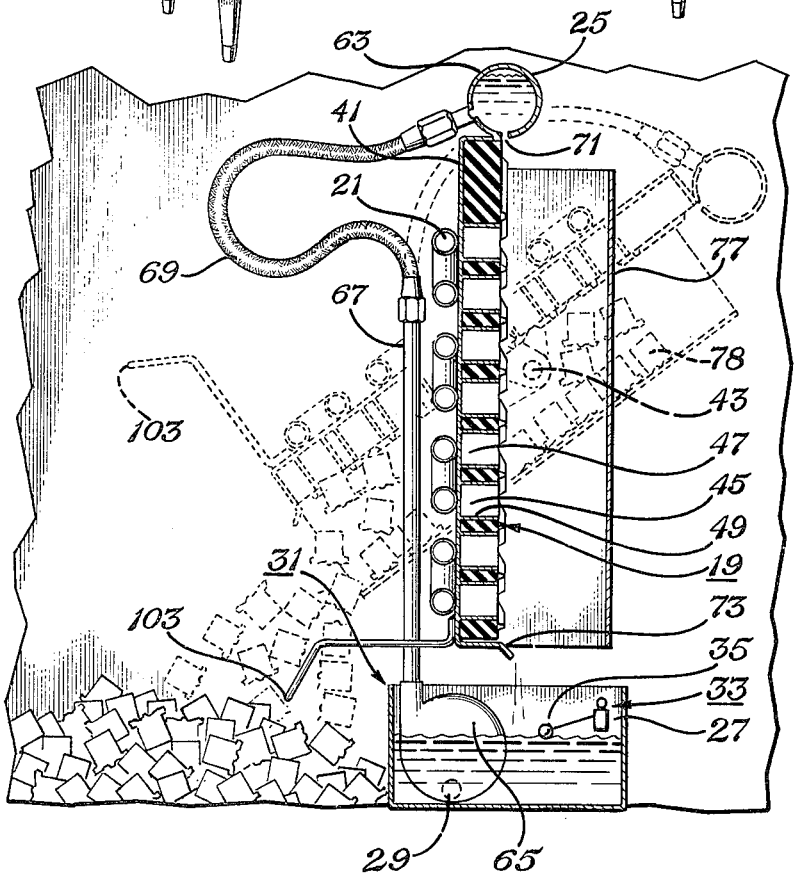
FIG. 2 is a partial side view, partly cross sectional and partly schematic showing a tiltable, substantially vertically oriented freezing mold in accordance with the embodiment of FIG. 1.
Figure 10:
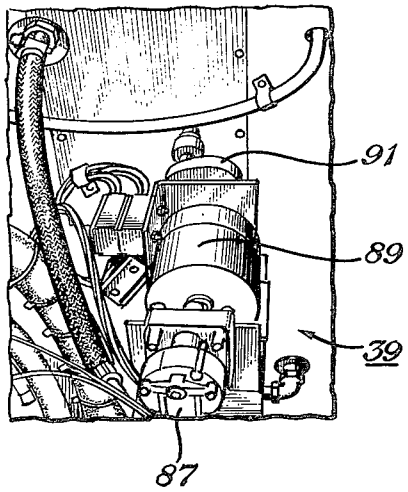
FIG. 10 is a partial perspective view of the dumping means and the sequencing switches.

The freezing apparatus 13 includes a freezing mold 19, FIG. 2, refrigerant tubes 21 secured to a wall of the freezing mold. The refrigerant tubes are also referred to as evaporator tubes, since they operate as an evaporator in the freezing mode. The refrigeration means 23, FIG. 1, is connected to include the evaporator tubes and adapted to circulate a refrigerant. The apparatus also includes a liquid dispensing means 25, FIG. 2, disposed above the freezing mold in its freezing mode so as to direct the freezing liquid substantially uniformly and continuously onto the upper cells of the freezing mold for freezing. The freezing apparatus 13 also includes the reservoir 27 for collecting excess liquid, drain means 29, a liquid circuit and pump means 31 connected with the reservoir so as to take suction therefrom and connected with the liquid dispensing means so as to circulate the liquid at substantially its freezing point; make-up means 33 for making up liquid to the reservoir; liquid level control means for controlling the liquid level in the reservoir; and a control means 37, FIG. 11, for controlling when the apparatus is in the freezing mode, dump mode, or de-energized. A means 39, FIG. 10, is provided for pivoting the freezing mold into its inclined position for dumping.

Figure 12:
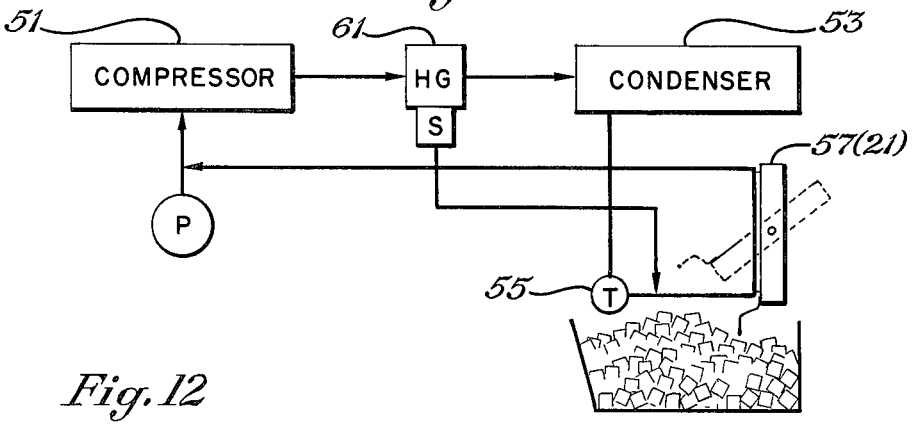
FIG. 12 is a schematic view of a refrigeration means connected with the freezing mold in accordance with one embodiment of this invention.

The freezing mold 19 is pivotally mounted and adapted to be positioned in a substantially vertical position in a freezing mode for freezing the liquid and to be inclined in a dump mode so as to dump the resultant frozen product. The freezing mold 19 has a plurality of respective cells arranged in a predetermined array and defining boundaries of a space of the predetermined shape of the frozen product. The freezing mold includes a main frame 41 that is supported by a pivot shaft 43 for pivotal movement between the freezing mode and the dumping mode. The freezing mold may have its plurality of cells arranged in any pattern. As indicated, the cells are substantially square in cross sectional shape and are arranged in rows and columns in a generally rectangular structure. The cells 45, FIGS. 2 and 3, may be formed in any of the conventional fashions. Preferably, the cells are formed by discrete sections cut from square, heat conductive tubes that are affixed, as by silver soldering or the like to a conductive back. Thus the conductive back 47 and the conductive sidewalls 49 provide 5 sides for conducting heat and freezing the product. Contrary to the prior art, the cells are not inclined at a downwards directed acute angle with respect to the back. The cells may be made of heat conductive material such as aluminum, copper or the like. While the refrigerant tubes are referred to as evaporator tubes, it is to be borne in mind that when a hot refrigerant valve is energized, hot refrigerant is flushed therethrough for heating the cells for dumping the ice cubes. The refrigerant tubes 21 are connected vi flexible piping, or tubing, to a conventional refrigeration apparatus, such as illustrated in FIG. 12. The details of the refrigeration apparatus are well known and do not need lengthy description herein. It is sufficient to note that the refrigeration means incorporates a compressor 51, FIG. 12, connected with a condenser 53 and then through a throttling valve 55 with the evaporator tubes 57 (21) for freezing the product. The refrigerant vapor, usually coming off the top of the tubes is circulated back by way of conduit 59 to the compressor 51. When the refrigeration means is employed as the heating means, a hot gas solenoid (HGS) valve 61 is employed to send the hot, compressed refrigerant to the evaporator tubes 21, shown as 57 in FIG. 12; and, thence, by way of conduit 59 back to the suction side of the compressor 51.

Figure 3:
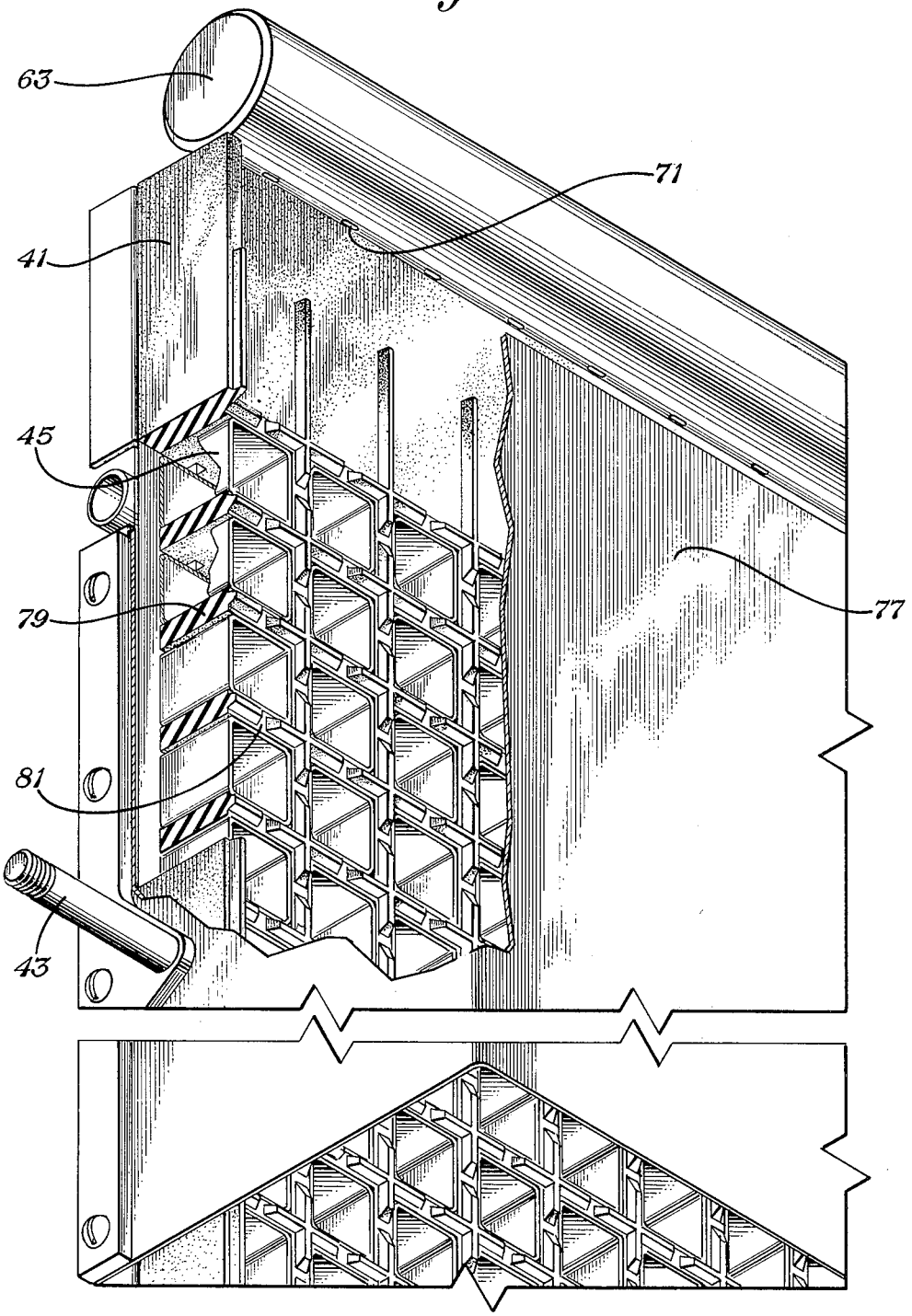
FIG. 3 is a partial isometric view of the freezing mold of FIG. 2 showing the deflection plate partly cut away to show the interior of the mold.

The liquid dispensing means 25 includes a water supply trough 63, FIGS. 2 and 3, on top of the freezing mold 19. The trough 63 is connected with the water circuit and the pump means 31 for supplying the liquid such as water substantially uniformly and continuously over the cells of the freezing mold 19. The excess liquid flows into the reservoir 27, FIG. 2, for collecting the excess liquid. The liquid circuit and pump means 31 comprises conduit, including flexible hose to enable the freezing mold to be tilted into the inclined position for dumping. The pump means 65, FIG. 2, takes suction from the reservoir and has its discharge connected by way of the conduits 67 and hose 69 with the trough 63. The trough 63 has a plurality of water outlets 71 adjacent the lower edge thereof.

It is worth emphasizing that flexible conduits are employed both for the water and the refrigerant in order to allow pivoting of the freezing mold into its dump position. A drain trough 73 is provided for directing any chilled but unfrozen liquid back to the reservoir 27.

The reservoir may comprise any suitable container ranging from plastic to copper, aluminum or the like. Preferably it has low heat conductivity to reduce heat flow into the cold liquid.

A make-up means 33 and a liquid level controller 35 are provided employing a float controlled valve for making up liquid such as water to the reservoir in keeping a predetermined liquid level therein.

A deflector plate 77 is provided for directing the frozen product such as the ice cubes 78, into the bin 15 and not into the reservoir 27. This can be seen in the phantom lines in FIG. 2.

It is noteworthy that the freezing mold 19 has an insert 79, FIG. 4, formed of rubber, plastic or the like. When in place, as illustrated in FIG. 3, the relative poor heat conducting insert 79 separate the respective cubes except for small valleys 81. These valleys, or notches, allow easily breakable tails 83, FIGS. 5 and 6 to form between the respective cubes 85. These tails have the advantage of interconnecting the cubes such that the cubes tend to fall from the freezing mold in the dumping mode in a mass as in the prior art. Yet, these tails do not freeze into a solid sheet that is difficultly broken, instead, the tails 83 are readily broken, even by the small fall into the bin.

Figure 11:
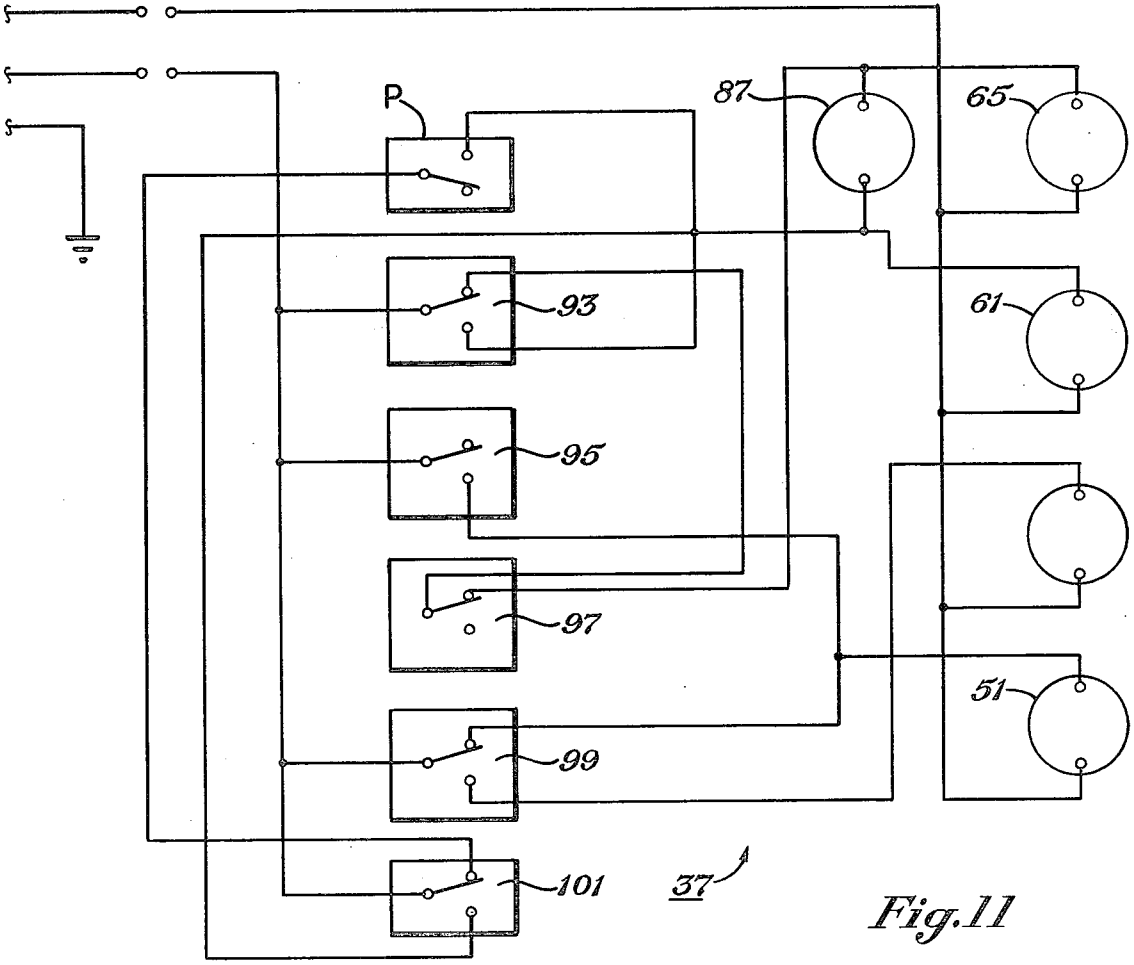
FIG. 11 is a schematic of the control circuit for controlling the apparatus of FIG. 1.
Figure 13:
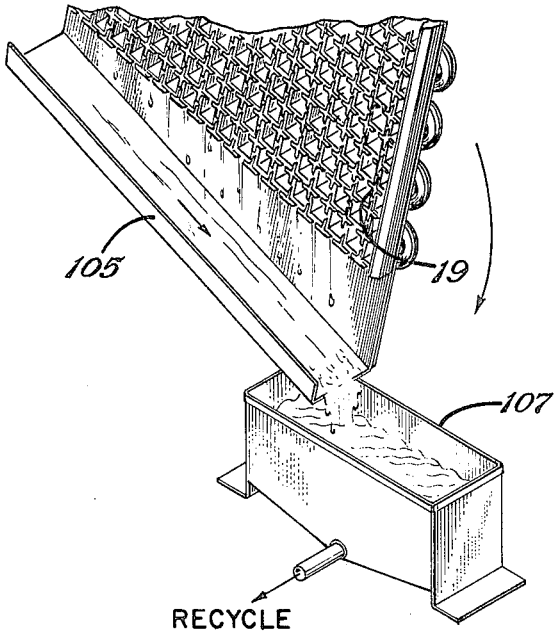
FIG. 13 is a partial schematic view showing a trough and reservoir into which the excess liquid returns when it flows over the freezing mold for recycle.

The suction switch, P, FIGS. 11 and 13, forms an economical easily maintainable switch for control of the modes. For example, the suction pressure drops to the range 7–8 pounds per square inch guage (PSIG), showing the refrigerant at about 5° F., to show that the control has frozen adequately and the dump mode should be initiated.

Figure 8:
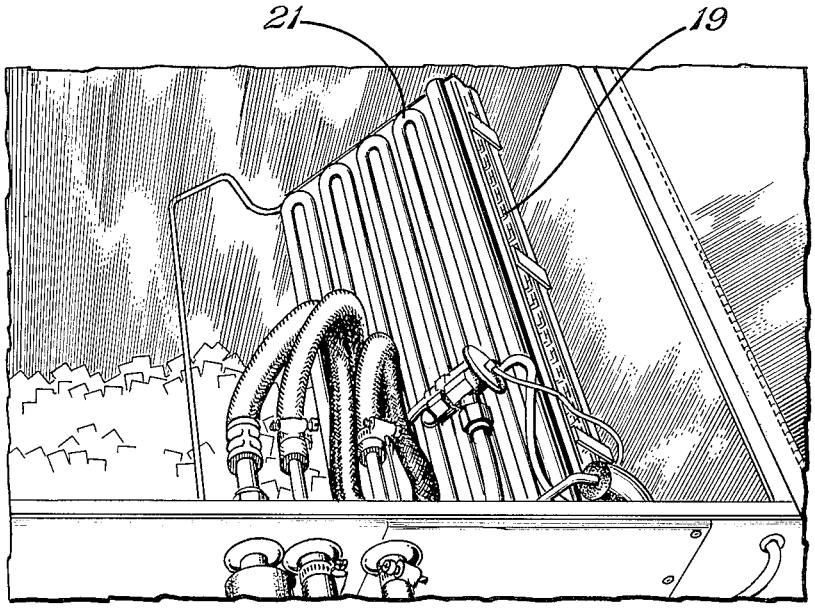
FIG. 8 is a partial isometric view of the apparatus of FIG. 7 with the freezing mold being inclined into the dump position.
Figure 9:
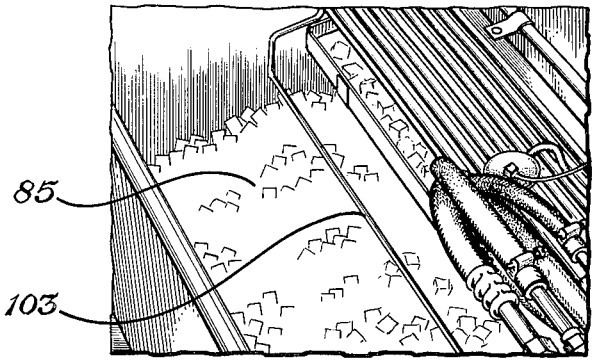
FIG. 9 is a perspective view of the interior of the bin showing the bar sensing that the bin is full.

One of the advantages of this system is that it can be activated at from as little as 6 to as high as 9 pounds per square inch guage and the ice cubes will still break apart readily. In the prior art, such economical controls would have formed thick sheets of material that would have prevented the ice cubes from being broken apart. In any event, when the suction switch P closes, the dump motor 87 is energized. The dump motor 87 is shown in FIGS. 7 and 10. The dump motor 87 rotates a gear reducer 89 serving as a timing means through a gear reduction. The gear reducer 89 rotates a cam 91 which engages a pair of switches referred to as pump cam switch 93, FIG. 11, and compressor cam switch 95. After the cam has been rotated about 3°, pump cam switch 93 is turned off and the compressor cam switch 95 is turned on to keep the compressor 51 running even after hot gas solenoid 61, FIG. 12, is energized. Once the cam starts running, the switch is closed to keep the motor running throughout the complete revolution of the cam and also to open the hot gas solenoid 61 to short circuit the hot compressor refrigerant to the refrigerant tubes 21 on the back of the freezing mold. As the cam rotates further, the freezing mold begins to be rotated into its inclined position. In its inclined position it is in the range of about 40°–60° for dumping the ice as soon as the hot compressor refrigerant has melted the frozen bond between the cells and the ice cubes. The first few degrees of tilt of the freezing mold effects operation of the pump tray switch 97 and the compressor tray switch 99. A manual defrost switch 101 is provided for operating manually. As can be seen in FIG. 8, the refrigerant tubes 21 on the back of the freezing mold conduct the hot refrigerant gases therethrough to release the freezing bond between the cubes and the respective cell walls and allow the ice to fall into the bin. As illustrated in FIG. 9, the ice cubes 85 fall into the bin. There is provided a safety guide 103 in the form of a bar for sensing when adequate cubes are included in the bin and prevent the freezing mold from returning to the freezing mode. Specifically, the switches 97 and 99 are de-energized if the tray does not return, to prevent the water pump from pumping and to prevent the compressor from running when adequate cubes exist in the bin. The switches also prevent the dump motor from returning the freezing mold into its upright position until some of the cubes have been used.

In operation the method of this invention is carried out as delineated hereinbefore. Specifically, the manual switch is put into the automatic position. The refrigerant system supplies liquid refrigerant to the evaporator cells 21 on the back side of the vertically oriented freezing mold 19. Water is circulated through the liquid dispensing means 25 to run downwardly over the cells that are heat conductive on five sides to conduct heat away from the water and freeze the water into ice cubes responsive to the cold refrigerant. The excess water flows back into the reservoir 27 to be picked up by the pump 65 and circulated again through the conduits 67 and 69. The water remains at substantially its freezing temperature until the ice cubes are frozen. When the ice cubes are frozen, inadequate heat conduction results in the low suction pressure in the order of 7–8 PSIG. This signals the conclusion of the freezing mode and initiating of the dumping mode. Accordingly, the compressor keeps running but with the hot gas solenoid 61 energized to short circuit the hot refrigerant gas to the refrigerant tubes 21 on the back of the freezing mold. This melts the freezing bond between the cell walls and the ice cubes, allowing the ice cubes to fall into the bin. The ice cubes 78, 85, have the respective tails 83 interconnecting the cubes such that when one starts, all the ice cubes are pulled from the freezing mold into the dumping mode. If the ice cubes do not pile up, the pump tray switch and compressor tray switch do not de-energize and the freezing mold returns to its upright position. When returned to the upright position, the timer in effect times out and the compressor switches are re-energized and the water pump switch is re-energized. The hot gas solenoid is de-energized and the hot gases are stopped from flowing through the refrigerant tubes 21. The refrigerant is started flowing through the condenser to liquify it, then through the throttling valve and in liquid form through the evaporator tubes 21 on the back of the freezing mold. The pump 65 circulates the liquid (water) over the freezing mold again. Thus the cycle is repeated until adequate ice cubes accumulate in the bin. When adequate ice cubes accumulate, the safety bar 103 senses that there are adequate ice cubes and re-positions the pump tray switch and the compressor switch 97, 99. This de-energizes the compressor and the water pump as well as the dump motor unitl some ice cubes are used. Thereafter, the dump motor is de-energized. The eccentrically mounted weight causes the return of the freezing mold to its vertical position and the cycle is resumed.

EXAMPLE

In this invention, the embodiment that has been found to be satisfactory is to operate the motor as a timer such that the first switch 93 remains closed about 90 seconds to keep the compressor operating for defrosting and melting the freezing bond of the ice cubes. It is thereafter open for about 55 seconds, allowing the ice to dump. About an additional 51 seconds is allowed to return the freezing mold to its upright position before the compressor and the water pump are again energized.

This unit can be made in a wide variety of sizes ranging from as little as 50 pounds per day to as many as 1500 pounds per day. In the embodiment first made, the unit made about 1100 pounds of ice cubes per day in its operating conditions.

Figure 14:
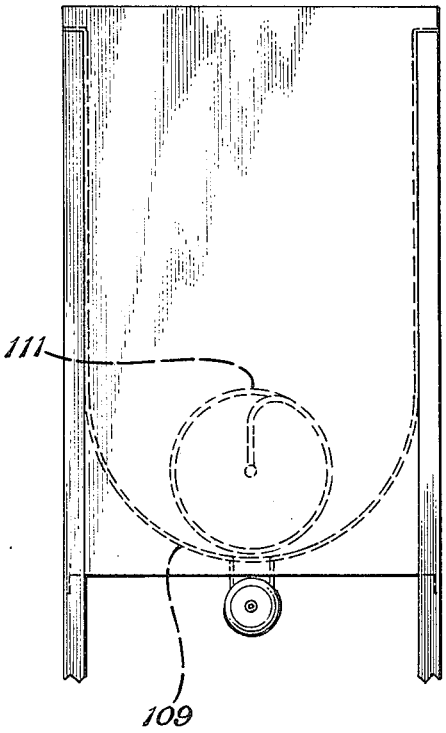
FIG. 14 is a partial side elevational view, partly cut away, illustrating schematically a preferred type bin for use with one embodiment of this invention.
Figure 15:
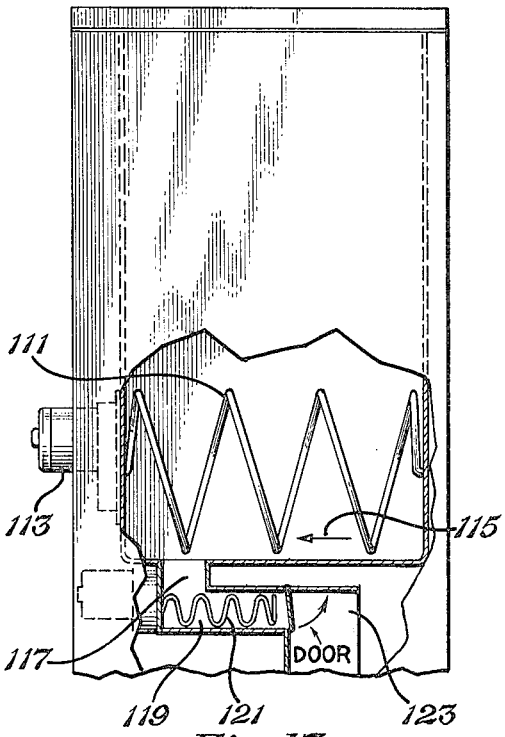
FIG. 15 is a side elevational view, partly cut away, showing the bin of FIG. 14.

Other features that have been found preferable in operational embodiments of this invention are illustrated in FIGS. 13–15. In FIG. 13, there is shown an inclined trough 105 for catching the excess water that flows over the freezing mold 19. The trough is inclined downwardly to deposit the water in the reservoir 107. The reservoir 107 may have the pump 65 as well as the makeup means 33 described hereinbefore with respect to FIG. 2. With the structure of FIG. 13, the trough 105 and the reservoir 107 can be emplaced by being affixed to the permanent structure such that freezing mold comes down to position its drain immediately above the trough 105 for dumping the excess water into the reservoir 107 for recycle.

In the preferred embodiment of the bin, shown in FIGS. 14 and 15, the bin has an arcuate bottom 109 for causing the ice cubes to move downwardly toward the center of the bin. A spiral 111, FIGS. 14 and 15, is rotatably journalled for rotation by a power means 113, such as an electric motor. The spiral may be of stainless steel, steel or other suitably strong material to move the ice cubes along the bottom. As shown by the arrows 115, FIG. 15 the ice cubes are moved to the downwardly opening aperture and chute 117 to fall into the horizontal chute 119. A second smaller spiral 121 is mounted for rotation in the chute 119 for moving the ice cubes to the door 123.

In operation, the embodiment of FIG. 13 is the same as described hereinbefore.

The operation of the embodiment of FIGS. 14 and 15 is that the ice cubes fall to the arcuate bottom 109 and are moved along the bottom by the spiral 111 when it is rotated until they fall through the aperture and chute 117 into the chute 119. The spiral 121 then moves the ice cubes to be accessible at the door 123. This allows individual servings as desired responsive to an element such as the key inserted into a switch, push button switch or the like (not shown).

This invention has been tried in both hot and cold weather and has been found to be eminently satisfactory. The maintenance is simple such that the units can be emplaced in field locations without having to have ruinously high service call charges or the like.

From the foregoing comment, it is evident that this invention achieves the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter purpose being had to the appended claims.

What is claimed is:

1. Apparatus for making a frozen product having a predetermined shape by freezing the liquid product, comprising:

a. a freezing mold pivotally and eccentrically mounted for pivotal movement about a pivot axis within a central one-half region of the longitudinal dimensions of said freezing mold and adapted to be positioned in a substantially vertical position in a freezing mode for freezing and to be inclined in a dump mode so as to dump the resulting frozen product; said mold having a plurality of respective cells arranged in a predetermined array and defining boundaries of a space of said predetermined shape of the frozen product;

b. evaporator tubes secured to a wall of the freezing mold;

c. refrigeration means for supplying liquid refrigerant to said evaporator tubes, flexible refrigerant conduits connecting said evaporator tubes and said refrigeration means such that said freezing mold can be pivoted about said pivot axis for dumping; said refrigeration means being adapted to circulate a refrigerant that cools or warms through change of state;

d. a liquid dispensing means disposed above said freezing mold in its freezing mode so as to direct said liquid substantially uniformly and continuously onto the upper said cells for freezing, said liquid flowing downwardly over said cells for freezing into said frozen product;

e. a reservoir for collecting excess liquid flowing over said freezing mold;

f. drain means for directing said excess liquid from said freezing mold to said reservoir;

g. liquid circuit and pump means connected with said reservoir so as to take suction therefrom and connected with said liquid dispensing means so as to circulate said liquid at substantially its freezing point;

h. make up means for making up liquid to said reservoir;

i. a liquid level control means for controlling the liquid level in said reservoir;

j. control means for determining when said apparatus is to be in said freezing mode and when it is to be in said dump mode and not in said freezing mode; and k. means for pivoting said freezing mold into its inclined position for dumping with said eccentric mounting for gravity return and wherein there is provided a receiving bin for receiving said frozen product when it is dumped wherein a "full" signal means if provided for signalling when said bin is full and preventing reentry into said freezing mode when said receiving bin has sufficient frozen product therein; said full signal means being defined by a protruding safety guide member that encounters said frozen product when there is adequate frozen product in said bin.

2. The apparatus of claim 1 wherein flexible lines are employed for flow of the respective fluids so as to enable rotation sufficiently to tilt the freezing mold 30°–45° between the freezing position and the dumping position.

3. The apparatus of claim 1 wherein there is provided a bin having an arcuate bottom and a rotatably mounted spiral for pulling the ice cubes along the arcuate bottom to a dump aperture and passageway, said dump aperture and passageway terminating in a second horizontal passageway and rotary, spiral for moving the ice cubes to a discharge door.

4. The apparatus of claim 1 wherein said drain means of element f. comprises an inclined trough that terminates above said reservoir such that the excess liquid flowing over said freezing mold will flow along said trough to said reservoir and allow said reservoir to be held permanently in the same position without having to tilt with said freezing mold.

5. Apparatus for making a frozen product having a predetermined shape by freezing the liquid product, comprising:

a. a freezing mold pivotally mounted and adapted to be positioned in a substantially vertical position in a freezing mode for freezing and to be inclined in a dump mode so as to dump the resulting frozen product; said mold having a plurality of respective cells arranged in a predetermined array and defining boundaries of a space of said predetermined shape of the frozen product;

b. evaporator tubes secured to a wall of the freezing mold;

c. refrigeration means for supplying liquid refrigerant to said evaporator tubes, said refrigeration means being connected with said evaporator tubes and adapted to circulate a refrigerant;

d. a liquid dispensing means disposed above said freezing in its freezing mode so as to direct said liquid substantially uniformly and continuously over the upper said cells for freezing, said liquid flowing downwardly over said cells for freezing into said frozen product;

e. a reservoir for collecting excess liquid flowing over said freezing mold;

f. drain means for directing said excess liquid from said freezing mold to said reservoir;

g. liquid circuit and pump means connected with said reservoir so as to take suction therefrom and connected with said liquid dispensing means so as to circulate said liquid at substantially its freezing point;

h. make up means for making up liquid to said reservoir;

i. a liquid level control means for controlling the liquid level in said reservoir;

j. control means for determining when said apparatus is to be in said freezing mode and when it is to be in said dump mode and not in said freezing mode; and k. means for pivoting said freezing mold into its inclined position for dumping;

said freezing mold including a poor heat conducting insert to separate respective said cubes as they are frozen; said insert having respective notches of predetermined dimensions smaller than the cube to effect freezing of adjacent cubes to each other with respective easily broken tails such that the weight of the cubes tend to effect dumping of all the cubes simultaneously and yet allow the cubes to separate by breakage of the respective tails rather than having a large mass of ice as in the prior art.

* * * * *